US009231340B2

(12) United States Patent
Decker et al.

(10) Patent No.: US 9,231,340 B2
(45) Date of Patent: Jan. 5, 2016

(54) RELEASEABLE ELECTRICAL CONTACT CONNECTION

(71) Applicant: CONTINENTAL AUTOMOTIVE GMBH, Hannover, DE (US)

(72) Inventors: Michael Decker, Regensburg (DE); Holger Schlotter, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/400,027

(22) PCT Filed: May 8, 2013

(86) PCT No.: PCT/EP2013/059610
§ 371 (c)(1),
(2) Date: Nov. 10, 2014

(87) PCT Pub. No.: WO2013/167665
PCT Pub. Date: Nov. 14, 2013

(65) Prior Publication Data

US 2015/0140844 A1 May 21, 2015

(30) Foreign Application Priority Data

May 9, 2012 (DE) ..... 10 2012 207 706

(51) Int. Cl.
*H01R 13/62* (2006.01)
*H01R 13/621* (2006.01)
(Continued)

(52) U.S. Cl.
CPC ..... *H01R 13/621* (2013.01); *H01R 4/34* (2013.01); *H01R 11/12* (2013.01); *H01R 13/5213* (2013.01); *H01R 13/5219* (2013.01); *H01R13/635* (2013.01); *H01R 13/5202* (2013.01); *H01R 13/5205* (2013.01)

(58) Field of Classification Search
CPC ..... H01R 13/621; H01R 4/34; H01R 11/12; H01R 13/5219; H01R 13/5213; H01R 13/635
USPC ..... 439/152, 159, 97, 559, 606, 709, 810
See application file for complete search history.

(56) References Cited

U.S. PATENT DOCUMENTS 7,811,116 B2 10/2010 Sakakura et al.
8,894,449 B2 * 11/2014 Matsumoto ..... H01R 4/34 439/727

(Continued)

FOREIGN PATENT DOCUMENTS

DE 3803321 C1 7/1989
DE 202009005412 U1 6/2009

(Continued)

*Primary Examiner* — Khiem Nguyen
(74) *Attorney, Agent, or Firm* — Laurence Greenberg; Werner Stemer; Ralph Locher

(57) ABSTRACT

A releasable electrical contact connection is formed between a first plug part and a complementary second plug part. The first plug part has an electrically conductive screw bolt on which a cable end can be mechanically and electrically connected by a threaded nut, the cable end and the threaded nut being part of the second plug connector. The cable end and the threaded nut are disposed in an insulating plug housing of the second plug part and are held movably in the direction of a longitudinal axis of the screw bolt in the plug housing, in order to establish or release the electrical and mechanical connection. The threaded nut can be rotated from outside the plug housing. The plug housing is surrounded by an insulating housing wall of the first plug part.

13 Claims, 6 Drawing Sheets

(51) Int. Cl.

| | |
|---|---|
| ***H01R 4/34*** | (2006.01) |
| ***H01R 11/12*** | (2006.01) |
| ***H01R 13/635*** | (2006.01) |
| *H01R 13/52* | (2006.01) |

(56) References Cited

U.S. PATENT DOCUMENTS 9,017,099 B2 * 4/2015 Ikeda ..... H01R 13/748 439/559
9,048,551 B2 * 6/2015 Picaud ..... H01R 4/34 1/1
2007/0105427 A1 5/2007 Mori et al.
2012/0231676 A1 9/2012 Picaud et al.

FOREIGN PATENT DOCUMENTS

EP 2144332 A1 1/2010
WO 2011061074 A1 5/2011
WO 2011157634 A1 12/2011

* cited by examiner

RELEASEABLE ELECTRICAL CONTACT CONNECTION

BACKGROUND OF THE INVENTION

Field of the Invention

The invention relates to a releasable electrical contact connection between a first plug part and a complementary second plug part.

This patent application claims the priority of German patent application no. 10 2012 207 706.5, the disclosure content of which is hereby included by reference.

Contact connections in which a cable end of a braided cable wire is attached to a nut serve to transport large electrical powers by means of high currents and high voltages. The ability to release the electrical contact connection is necessary, for example, in order to carry out servicing work or to replace defective systems and devices which are contact-connected by the contact connection. It is further necessary to keep the contact resistances between the line contact elements as low as possible.

Typically, a cable shoe is arranged at the cable end of the braided cable wire and connected to the braided cable wire by plastic deformation. A customary method for establishing the connection is what is known as "crimping". The cable shoe is releasably connected to the screw bolt by means of a screw-clamping connection. This results in low electrical transfer resistances in the contact system. In order to protect against the ingress of moisture and also to electrically insulate high voltages, a separate cover is fitted over the contact connection. The contact connection is established at the contact system, which is disconnected from the voltage supply, using an insulated tool.

BRIEF SUMMARY OF THE INVENTION

One object of the present invention is to further improve a releasable electrical contact connection of the above-described type in respect of structure and/or function.

This object is achieved by an electrical contact connection having the features described below. Advantageous refinements and developments of the electrical contact connection are specified in the dependent claims.

In a releasable electrical contact connection according to the invention between a first plug part and a complementary second plug part, the first plug part has an electrically conductive screw bolt to which a cable end can be mechanically and electrically connected by means of a nut. The cable end and the nut are parts of the second plug connector. The cable end and the nut are arranged in an insulating plug housing of the second plug part and are held such that they can move in the plug housing in the direction of a longitudinal axis of the screw bolt in order to establish or in order to release the electrical and mechanical connection. The nut can be turned from outside the plug housing. The plug housing is surrounded by an insulating housing wall of the first plug part.

The invention provides a releasable electrical contact connection which is sealed off from environmental influences not only on account of the arrangement of the electrically conductive components in respective housings, but rather electrical insulation is also provided as the screw connection is established. This has the advantage that it is not necessary to disconnect the contact connection from the voltage supply in order to establish the electrical connection or to release the electrical connection. In the process, the contact connection is sealed without a separate working step. It is only necessary for the housings of the first plug part and of the second plug part to engage with one another. This results in increased operational safety in respect of an electric shock compared to a direct screw arrangement.

In an expedient refinement, an outer wall of the plug housing bears against the housing wall of the first plug housing by means of a sealing element, wherein the volume which is enclosed by the outer wall is divided into a first and at least a second part by a partition wall which extends in the direction of the longitudinal axis. The cable end and the nut are arranged such that they can move in the first part of the plug housing, which first part is in the form of a guide sleeve. A braided cable wire is routed out of the plug housing by means of the second part. Splitting the plug housing into a first and a second part makes it possible to provide a contact connection which is sealed off from environmental influences and at the same time allows the electrical and mechanical connection to be established or released in the live state of the contact connection. In particular, the division makes it possible to seal off both the braided cable wire which is routed out of the plug housing and also the volume of the plug housing, which volume is used for the screw arrangement, toward the outside in a simple manner.

In particular, the braided cable wire can be routed out of the second part of the plug housing by a braided wire seal which seals off the second part from the surrounding area. The braided wire seal can be realized, for example, by extrusion-coating the braided cable wire with a sealing material. By way of example, a molding compound material, such as PU (polyurethane), silicone, acrylic etc. for example, can be introduced into the second part of the plug housing for this purpose.

The partition wall preferably has a recess through which the cable end which is connected to the braided cable wire is routed. The cable end of the braided cable wire is preferably routed through the recess and into the first part of the plug housing, before the braided wire seal is introduced into the second part of the plug housing.

In a further expedient refinement, the partition wall and the section of the outer wall which adjoins the first part together have a cross-sectional shape which is approximately circular in a plane perpendicular to the longitudinal axis. As a result, the partition wall and the section of the outer wall can constitute a guide for the nut which is to be turned onto the screw bolt. This prevents problems during assembly and makes it easier to establish or release the electrical and mechanical connection.

It is further expedient when, after the connection is established, the first part is closed by an insulating cover which is pressed against the wall of the first part by means of a seal. The first part of the plug housing is sealed off from environmental influences by the insulating cover.

According to a further expedient embodiment, a screw body is arranged in the plug housing, said screw body being mounted such that it can be displaced in the direction of the longitudinal axis in the plug housing and it being possible for said screw body to engage in an interlocking manner with the nut by the application of force in order to establish the connection of the cable end to the screw bolt or in order to release the connection of the cable end to the screw bolt. The screw body which is preferably formed from an insulating material, as a tool which is integrated in the second plug part, makes it possible to establish or to release the electrical and mechanical connection between the electrical contact partners. In this case, the screw body is released by the nut in an inoperative position by virtue of the displaceable mounting. If the screw body engages with the nut, the screw body is displaced along the longitudinal axis in the direction of the nut until said screw body and nut engage such that the screw bolt can be turned by the nut being turned.

In this case, the screw body is routed in the first part, which forms a guide sleeve, so that the screw body and nut cannot tilt. In particular, after the connection is established, the screw body remains permanently in the plug housing.

In a further refinement, force is applied in the direction of the screw bolt against a spring force which is generated by a spring, for example a helical spring, which is arranged between the screw body and a termination surface of the first part. In this case, the screw body is pressed against the termination surface by the spring force of the spring by means of a seal in an inoperative position. As a result, the screw body at the same time also seals off the first part of the plug housing in connection with the termination surface.

In a further refinement, the screw body engages with the nut by means of a spring element in order to establish or release the connection, as a result of which a maximum torque, which is determined by the shape of the spring, cannot be exceeded. The spring element is arranged radially between the screw body and the nut. The spring element, which can be of integral design or multipartite design, preferably engages in cutouts in the nut which transmit torque to the nut when the screw body is rotated. When a torque limit value is exceeded, the spring element is deformed, as a result of which the spring element slides through the cutouts. As a result, the tightening torque of the nut is limited without a separate assembly tool. The audible latching provides audible feedback in respect of the minimum required tightening torque.

In order to obtain a transfer resistance between the screw bolt and the cable end of the second plug part which has as low an impedance as possible, it is expedient when the cable end has a cable shoe. To this end, the end of braided cable wire can be connected to a cable shoe, which is mounted in the first part of the plug housing such that it can slide, for example by plastic deformation.

Further advantages, features and refinements of the invention will be explained below with reference to exemplary embodiments in the drawing. In said drawing, identical elements are provided with the same reference symbols in the various exemplary embodiments. The elements illustrated in the exemplary embodiments are only schematically illustrated. In particular, the sizes in a contact connection which is realized in practice and also the relationships between said sizes can also be different. In the drawing:

DESCRIPTION OF THE INVENTION

Figure 1:
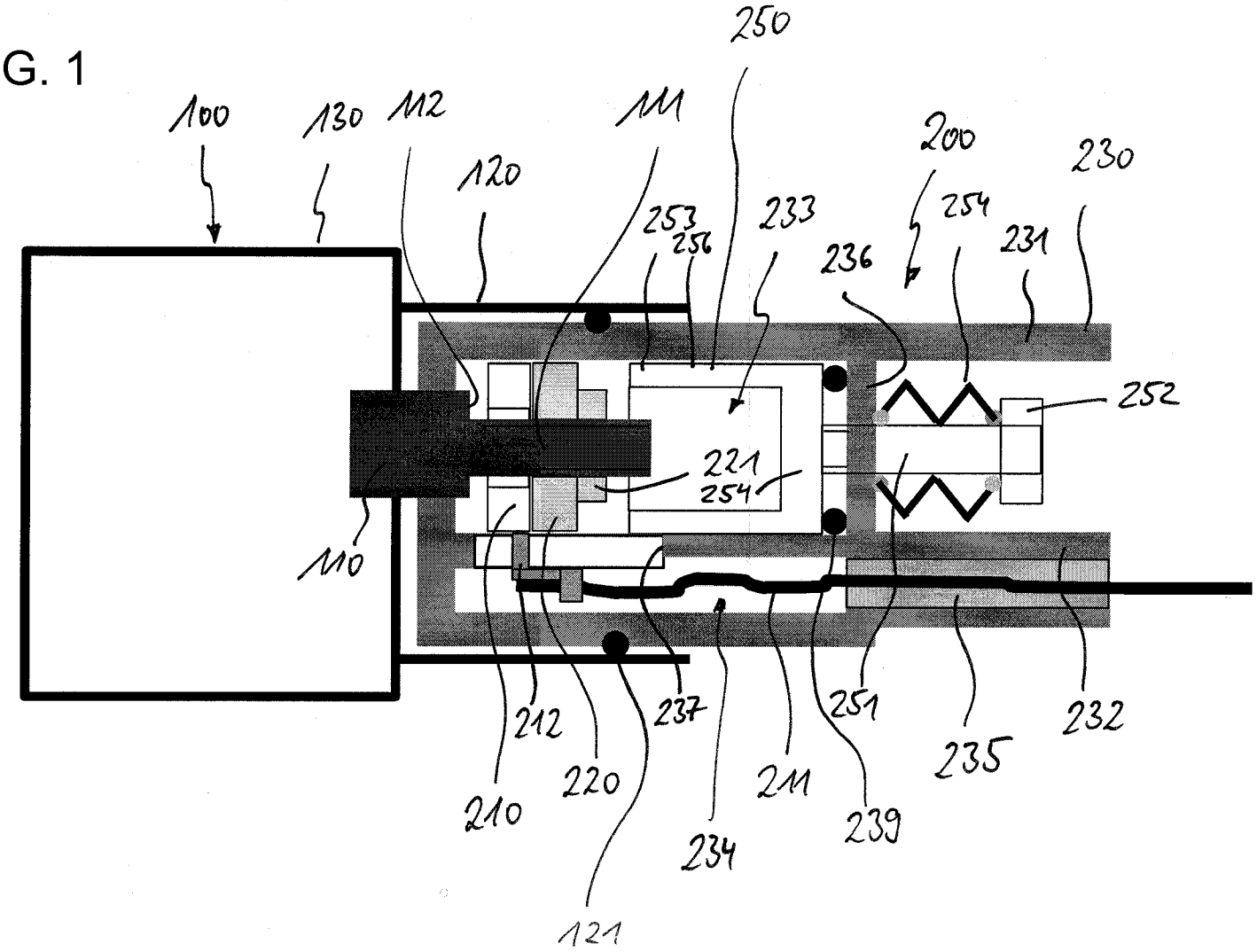
FIG. 1 shows a schematic cross-sectional illustration of a contact connection according to the invention between a first plug part and a complementary second plug part.

FIG. 1 shows, in a schematic cross-sectional illustration, a releasable electrical contact connection between a first plug part 100 and a complementary second plug part 200.

The first plug part 100 is integrated, for example, on or in an electrical device 130. The first plug part comprises a screw bolt 110 which protrudes out of the housing of the electrical device 130. The screw bolt 110 comprises a threaded shaft 111. An abutment surface 112 which has a diameter which is larger than the diameter of the threaded shaft 111 is formed at the base of the threaded shaft 111. The abutment surface 112 and the threaded shaft 111 can be of integral design. Said abutment surface and threaded shaft can likewise be connected to one another in a mechanical and electrical manner. The screw bolt 110 is surrounded by an insulating housing wall 120. The housing wall 120 can be of round, oval, polygonal or similar design in a plane which runs perpendicular to a longitudinal axis of the screw bolt. The housing wall 120 and the housing of the electrical device can selectively be produced integrally or in a multipartite manner from the same material, for example from a plastic. The outer edge of the housing wall 120 preferably projects, as is illustrated in FIG. 1, beyond the end of the screw bolt 110. The outer edge of the housing wall 120 is at least flush with the end of the screw bolt 110.

The second plug part 200 comprises a plug housing 230 which is formed from an insulating material and in which all of the components which are necessary for making electrical contact with the screw bolt 110 are integrated. The plug housing 230 performs the task firstly of providing insulation protection during assembly work. Secondly, the plug housing, in interaction with the housing wall 120 of the first plug part 100, also ensures that the contact connection is sealed off.

The plug housing 230 comprises an outer wall 231 which has a shape which complements the housing wall 120 of the first plug part 100. When the plug connection between the first and the second plug part 100, 200 is established, a gap which is formed between the housing wall 120 and the outer wall 231 is closed by means of a sealing element 121. The sealing element 121 can selectively be provided on the outside of the outer wall 231 or the inside of the housing wall 120 of the first plug part 100. The sealing element may be, for example, an O-ring which is introduced into a groove in the corresponding wall and fixed there, for example. The sealing element 121 may likewise be a sealing element which is molded onto the corresponding wall.

The volume which is enclosed by the outer wall 231 of the second plug part is divided into a first and a second part 233, 234 by a partition wall 232 which extends in the direction of the longitudinal axis (that is to say an axis which extends from left to right in the plane of the sheet). The partition wall 232 and the section of the outer wall 231 which adjoins the first part 233 together preferably form a cross-sectional shape which is approximately circular in a plane perpendicular to the longitudinal axis. The walls (partition wall 232 and part of the outer wall 231) which adjoin the first part 233 form a guide sleeve for a cable shoe 210, which is arranged axially above the screw bolt 110, and also a nut 220. The cable shoe constitutes a cable end of the cable which is routed out of the second plug connector 200, more precisely of a braided cable wire 211. The cable shoe 210 is connected by means of a connecting element by means of which the braided cable wire 211 can be crimp-connected to said cable shoe. The crimping element 212 is routed through the recess 237 in this case, so that the end of the braided cable wire comes to rest in the second part 234 of the plug housing 230.

Figure 5:
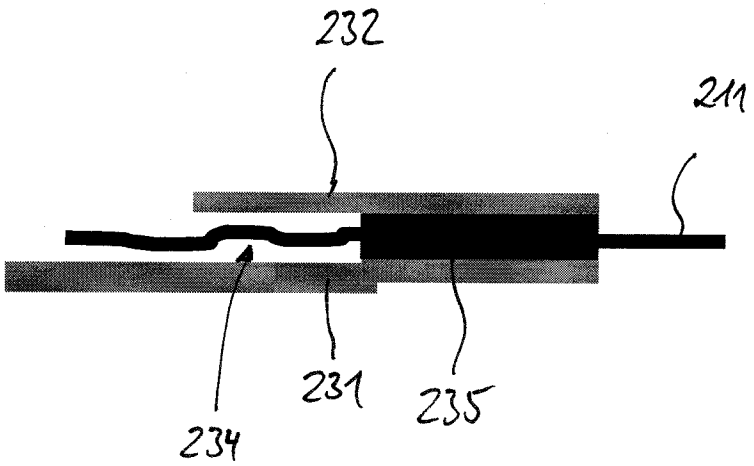
FIG. 5 shows an enlarged illustration of the seal of a braided cable wire which is routed out of the second plug part.

The braided cable wire 211 is routed through a braided wire seal 235, out of the second part 234 of the plug housing, to the outside. The braided wire seal 235 seals off the second part 234 from environmental influences. The braided wire seal, which is illustrated in an enlarged manner in FIG. 5, can be formed, for example, by extrusion-coating the braided cable wire 211 with a molding compound material, for example PU, silicone, acrylic etc. The molding compound material of the braided wire seal 235 can in this case already be formed, for example, when the cable shoe 210 is already mounted such that it projects through a recess 237 in the partition wall 232 and slides in an axial manner in the interior of the first part. The braided wire seal 235 is therefore preferably produced before a mechanical connection between the first and the second plug part 100, 200 is established.

The cable shoe 210 which is arranged in the first part 233 can optionally be provided with a widened portion. The nut 220 which is arranged adjacent to the cable shoe 210 is then preferably formed with a disk which is provided with an undercut. The undercut in the disk engages in the widened portion of the cable shoe in such a way that rotation between the cable shoe and the nut 220 is made possible. This structural refinement detail cannot be seen in any detail in FIG. 1.

In the first part 233 of the plug housing 230, which first part is in the form of a sealing sleeve, a cylindrical screw body 250 is arranged on that side of the nut 220 which is averted from the cable shoe 210. The screw body 250, which is illustrated in an inoperative position in FIG. 1, has a pot-like shape in the interior of the first part 233. A shaft 251 passes through a cutout in a termination surface 236, which runs transverse to the longitudinal axis, in the direction of the outer surrounding area. The shaft ends in a grip piece 252 which at the same time serves as an abutment surface for a spring element 254 which is arranged between the grip piece and the termination surface 236. The spring element 254 may be in the form of, for example, a helical spring.

The spring force which is generated by the spring element 254 presses the screw body 250 into the inoperative position, which is shown in FIG. 1, without further application of force. A seal 239 is arranged between a bottom surface 254 of the screw body 250 and the termination surface 236. Owing to the spring force, the bottom surface 254 is pressed against the seal 239, so that the first part 233 of the plug housing 230 is sealed off from environmental influences.

An engagement section 253 is formed at an outer end of a wall 256 of the screw body 250, said engagement section being matched to an engagement section 212 of the nut 220 in respect of size and shape. Owing to the matching shape, it is possible for the screw body to form a frictional interlocking connection with the nut 220 in order to transmit necessary tightening torques for the nut.

If the screw body 250 is produced from an insulating material, the screw arrangement can also be established, that is to say the connection between the contact shoe 210 and the screw bolt 110 can be established, when the contact connection is live.

In order to establish the frictional interlocking connection between the engagement section 235 of the screw body 250 and the nut 220, it is necessary to overcome the spring force which is generated by the spring 254.

When establishing or releasing the electrical connection between the screw bolt 110 and the cable shoe 210, the screw body 250 can selectively be manually operated by means of the grip piece 252. Engagement using another, external tool (screwdriver, socket wrench) can likewise be performed by shaping the grip piece 252.

Figure 2:
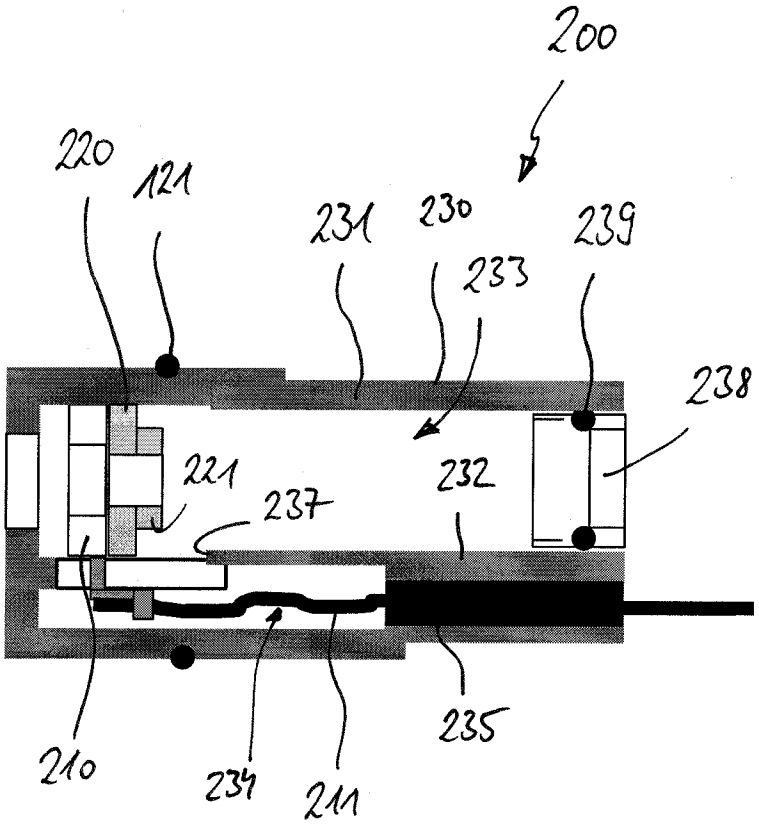
FIG. 2 shows a first, alternative variant refinement of a second plug part of an electrical contact connection according to the invention.

FIG. 2 shows a second, alternative refinement of the second plug part 200. In contrast to the preceding, first exemplary embodiment in FIG. 1, there is no screw body mounted in the interior of the first part 233. Instead, a tool is inserted into the first part 233 in order to establish a frictional interlocking connection with the engagement section 221 of the nut 220 by means of said tool in order to establish the electrical connection. After the connection has been established or released, the first part 233 is closed (sealed off) by a cover 238. The outer circumference of the cover 238 has a seal 239 which is composed of an elastic material, so that the first part 233 is sealed off from environmental influences from the outside.

Figure 3:
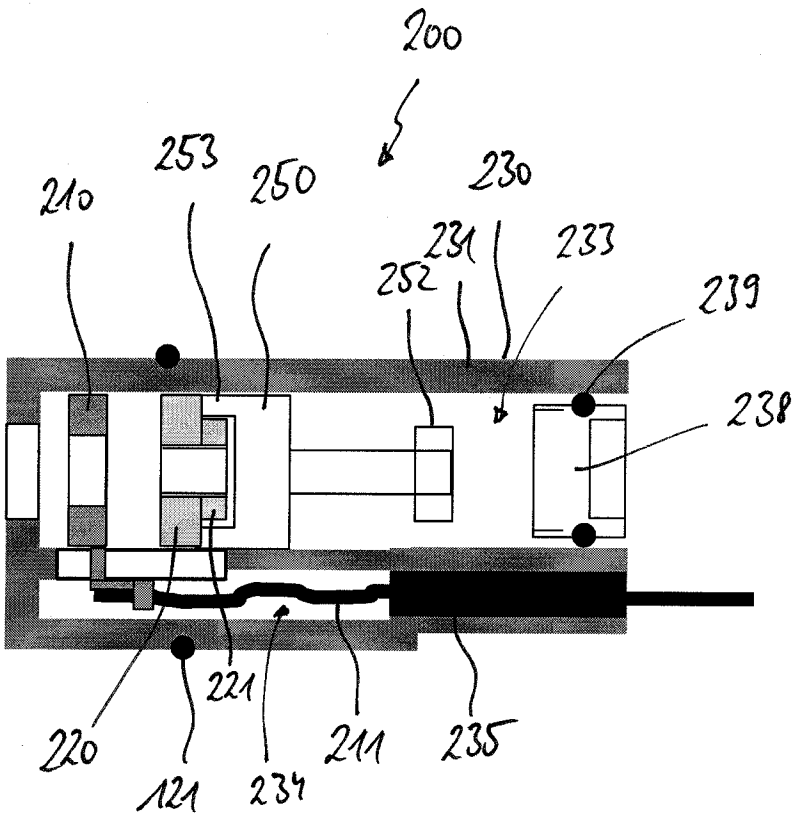
FIG. 3 shows a second, alternative variant refinement of a second plug part of an electrical contact connection according to the invention.

In a further modification which is illustrated in FIG. 3, the interior of the first part 233 is likewise closed by the cover 238. In addition, a screw body 250 is arranged in the first part 233 and preferably fixedly connected to the screw 220 in a frictionally interlocking manner. The cover 238 first has to be removed before the electrical connection is established or released. The grip piece 252 of the screw body 250 can then be turned using a tool.

Figure 4:
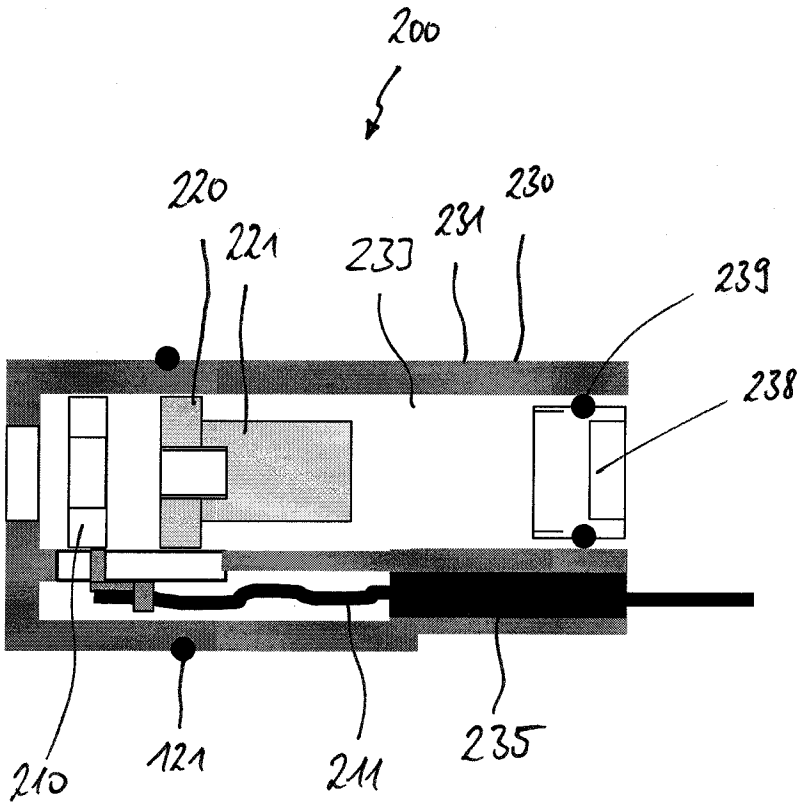
FIG. 4 shows a third, alternative variant refinement of a second plug part of an electrical contact connection according to the invention.

A similar refinement is illustrated in FIG. 4, wherein the engagement section 221 of the screw body 220 is larger in the axial direction in this case. After the cover 238 which closes the first part 233 has been removed, the nut 220 can be turned by a tool which engages on the inside, for example a socket wrench.

Figure 7:
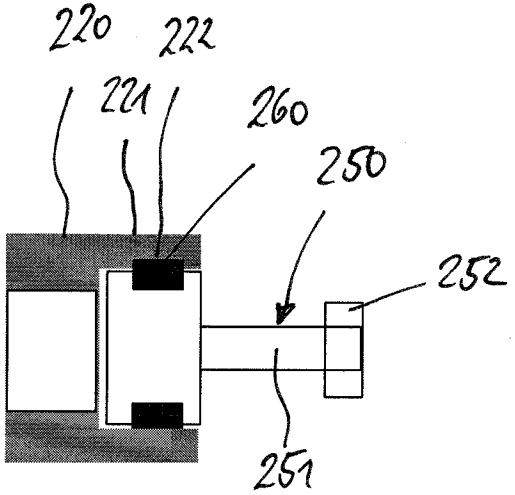
FIG. 7 shows a further cross-sectional illustration along the screw body, which is provided with a torque-limiting means, in engagement with a nut.
Figure 6:
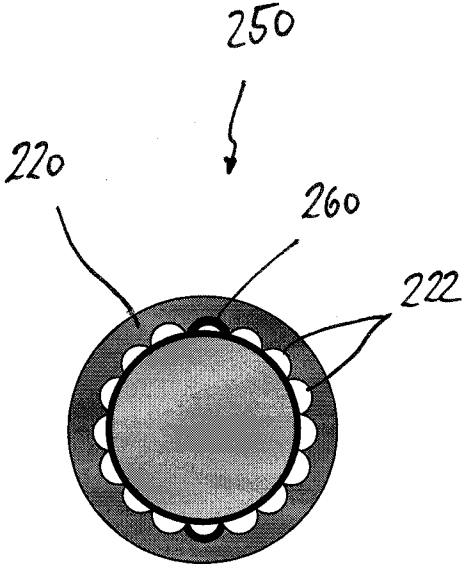
FIG. 6 shows a cross-sectional illustration of a torque-limiting means which is integrated in a screw body.

In a further refinement which is illustrated in different cross-sectional views in FIGS. 6 and 7, the screw body 250 can be provided with one or more surrounding or individual spring elements which engage in cutouts, so-called latching recesses 222, in the nut 220. When the screw body 250 is rotated, a torque is transmitted to the nut 220 by means of the spring 260. When a torque limit value is exceeded, this results in deformation of the spring element 260. As a result, the spring element 260 slides through the latching recesses 222 which are in the shape of a segment of a circle. As a result, the tightening torque of the nut is limited without a separate assembly tool. At the same time, audible feedback is provided on account of the spring element latching into the latching recesses when the torque limit value is exceeded.

In the case of the proposed screw connection, the cable shoe, the nut and the sealing system form a unit which is realized in the second plug part. The contact system can be sealed without a separate working step by the first and the second plug part being mechanically connected to one another. It may optionally be necessary to provide the cover in order to seal off the first part of the plug housing from the second plug part.

Assembly and removal can also be performed in the live state owing to the insulating design of the screw body. This provides increased operational safety in respect of electric shocks over the direct screw arrangement which is known from the prior art.

The invention is not restricted to the exemplary embodiments on account of the description on the basis of these exemplary embodiments. Instead, the invention comprises any new feature and any combination of features which includes, in particular, any combination of features in the exemplary embodiments and patent claims.

The invention claimed is:

1. A releasable electrical contact connection, comprising:

a first plug part and a complementary second plug part to be interconnected;

said first plug part having an electrically conductive screw bolt with a longitudinal axis;

said second plug part having an insulating plug housing, a cable end disposed in said plug housing and a nut disposed in said plug housing;

said nut configured to be turned from outside said plug housing and said nut providing a mechanical and electrical connection between said cable end and said screw bolt;

said cable end and said nut being movable in said plug housing in a direction of said longitudinal axis to establish or release said mechanical and electrical connection; and said first plug part having an insulating housing wall surrounding said plug housing.

2. The contact connection according to claim 1, wherein:

said plug housing of said second plug part has an outer wall enclosing a volume of said plug housing;

a sealing element is disposed between said housing wall of said first plug part and said outer wall of said second plug part;

a partition wall extends in said direction of said longitudinal axis and divides said volume into a first part formed as guide sleeve and at least one second part;

said cable end and said nut are disposed in and movable in said first part of said volume of said plug housing; and a braided cable wire is routed out of said plug housing by said at least one second part.

3. The contact connection according to claim 2, which further comprises a braided wire seal routing said braided cable wire out of said at least one second part of said plug housing and sealing off said at least one second part from a surrounding area.

4. The contact connection according to claim 2, wherein said partition wall has a recess formed therein, and said cable end is routed through said recess and connected to said braided cable wire.

5. The contact connection according to claim 2, wherein said outer wall has a section adjoining said first part, and said partition wall and said section together have a cross-sectional shape being approximately circular in a plane perpendicular to said longitudinal axis.

6. The contact connection according to claim 2, wherein said first part has a wall, an insulating cover closes said first part, and a seal presses said insulating cover against said wall of said first part, after establishing said connection.

7. The contact connection according to claim 2, which further comprises a screw body disposed in said plug housing, said screw body being mounted for displacement in said direction of said longitudinal axis in said plug housing and said screw body being configured to engage in an interlocking manner with said nut by an application of force to establish said connection of said cable end to said screw bolt or to release said connection of said cable end to said screw bolt.

8. The contact connection according to claim 7, wherein said screw body is disposed in said first part of said plug housing.

9. The contact connection according to claim 7, wherein said screw body remains permanently in said plug housing, after establishing said connection.

10. The contact connection according to claim 7, wherein:

said first part has a termination surface;

a spring is disposed between said screw body and said termination surface and generates a spring force; and said force is applied in direction of said screw bolt against said spring force.

11. The contact connection according to claim 10, which further comprises a seal pressing said screw body against said termination surface in an inoperative position.

12. The contact connection according to claim 7, which further comprises a spring element engaging said screw body with said nut to establish or release said connection and to prevent a maximum torque determined by a shape of said spring from being exceeded.

13. The contact connection according to claim 1, wherein said cable end has a cable shoe.

* * * * *